US005672267A

United States Patent [19]

Terblanche

[11] Patent Number: 5,672,267

[45] Date of Patent: Sep. 30, 1997

[54] FLOTATION COLUMN WITH CONSTANT FEED ARRANGEMENT

[75] Inventor: Nardus Terblanche, Kempton Park, South Africa

[73] Assignee: Multotec Cyclones (PTY) Limited, South Africa

[21] Appl. No.: 658,280

[22] Filed: Jun. 5, 1996

[30] Foreign Application Priority Data

Jun. 6, 1995 [ZA] South Africa ..... 95/4638

[51] Int. Cl.[6] ..... B03B 1/00; B03D 1/02; B03D 1/24

[52] U.S. Cl. ..... 209/164; 209/170

[58] Field of Search ..... 209/164, 168, 209/169, 170

[56] References Cited

U.S. PATENT DOCUMENTS

| | | |
|---|---|---|
| 2,142,207 | 1/1939 | Price . |
| 3,428,175 | 2/1969 | Hukki . |
| 5,116,487 | 5/1992 | Parekh . |
| 5,188,726 | 2/1993 | Jameson . |

OTHER PUBLICATIONS

Changgen, Li and Bahr, A; "Flotation of Copper Ore in a Pneumatic Flotation Cell" Minerals and Metallurgical Processing Feb. 1992 pp. 7–12.

*Primary Examiner*—Thomas M. Lithgow

*Attorney, Agent, or Firm*—Webb Ziesenheim Bruening Logsdon Orkin & Hanson, P.C.

[57] ABSTRACT

A method and apparatus for separating particulate material. The method includes the steps of delivering a substantially constant supply of feed to a first aerator, aerating the substantially constant supply of feed in the first aerator, introducing the substantially constant supply of aerated feed to a flotation vessel below a froth/liquid interface within the vessel, so that floatable particulate material entrained by air bubbles from the first aerator can float upwardly to the froth/liquid interface. Air is introduced into the liquid phase in the flotation vessel via a second aerator located below the level at which the aerated feed is introduced into the flotation vessel, so that floatable particulate material not entrained by air bubbles from the first aerator, may be entrained by air bubbles from the second aerator, as the air bubbles from the second aerator rise upwardly through the liquid phase to the froth/liquid interface.

4 Claims, 1 Drawing Sheet

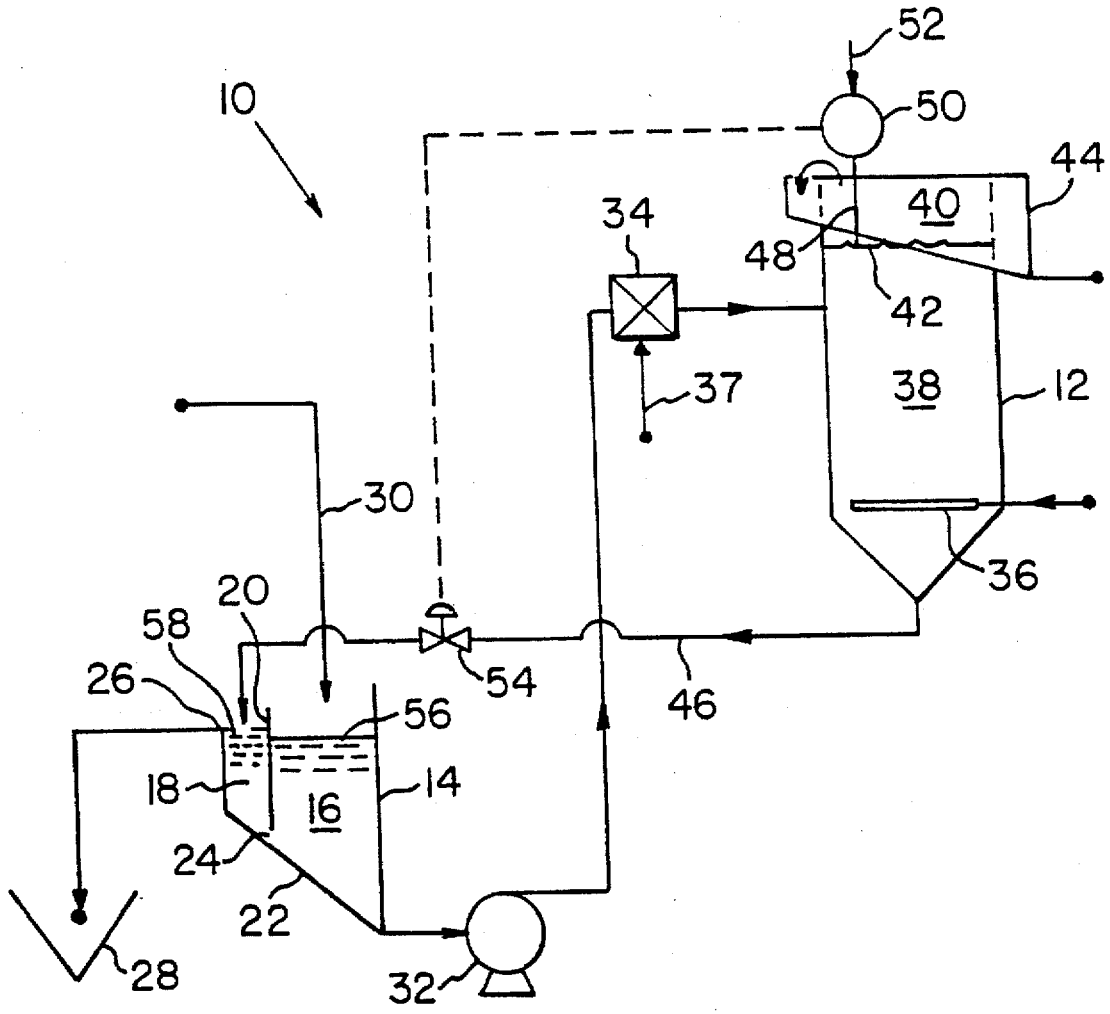
52
50
10
44
40
34
48
42
37
38
12
30
36
20
58
54
26
46
56
18
14
16
24
22
28
32

FLOTATION COLUMN WITH CONSTANT FEED ARRANGEMENT

FIELD OF THE INVENTION

This invention relates to a method of separating particulate material and to a flotation plant.

DESCRIPTION OF THE PRIOR ART

Particles can be separated by way of column flotation or pneumatic flotation. Column flotation may involve the introduction of a slurry towards the top of a column and the introduction of air bubbles towards the bottom of the column. At least some of the hydrophobic ore particles in the slurry become attached to the rising air bubbles and form a froth towards the top of the column. The froth is drawn off the column and the hydrophobic particles can be recovered from the froth. Pneumatic flotation on the other hand may involve the mixing of air and slurry in an aerator before the slurry is introduced into a separating vessel. Once in the separating vessel, the air bubbles together with the entrained hydrophobic slurry particles are also separated in the form of a froth from the rest of the slurry.

The capacity of column flotation is limited by the carrying capacity of the bubbles passing through the column, and by the fact that the total flowrate of bubbles that can be passed through the column is limited. Poor mixing characteristics of the slurry phase also result in the bubbles bypassing floatable particles. This leads to a loss in recovery. The capacity of pneumatic flotation is also limited because the as to slurry ratio cannot exceed a certain value, and because of the short residence time of floatable particles in the aerator. Particles that detach from the bubbles due to turbulence in the pulp phase or due to bubble coalescence in the froth phase, are generally given little chance to make contact with bubbles again, and so are lost to the tailings stream.

A further problem associated with prior art flotation vessels lies in the erratic nature of the feed supply to the vessels. An erratic feed supply causes unstable operation. This in turn results in a flotation vessel which performs poorly. By keeping the solids and volumetric flow-rates to the flotation vessel constant, flotation performance can be enhanced.

In the past the problem of erratic feed supply to a flotation vessel was overcome by the use of large buffer feed tanks, or by the controlled addition of water to the feed supply. Disadvantages of the large buffer feed tanks include the large space requirement and their relatively high cost. A disadvantage of the controlled addition of water to the feed supply, is that this results in dilution of the feed and consequent fluctuation in the flow rate of feed solids.

OBJECT OF THE INVENTION

It is accordingly an object of this invention to provide a method of separating particulate material, and a flotation plant, which will at least reduce the disadvantages associated with the prior art.

BRIEF DESCRIPTION OF THE DRAWING

FIG. 1 is a diagrammatic layout of a flotation plant of the invention.

SUMMARY OF THE INVENTION

According to the invention a method of separating particulate material includes the steps of:

delivery a substantially constant supply of feed to a first aerator;

aerating the substantially constant supply of feed in the first aerator;

introducing the substantially constant supply of aerated feed to a flotation vessel below a froth/liquid interface within the vessel, so that floatable particulate material entrained by air bubbles from the first aerator can float upwardly to the froth/liquid interface; and introducing air into the liquid phase in the flotation vessel via a second aerator located below the level at which the aerated feed is introduced into the flotation vessel, so that floatable particulate material not entrained by air bubbles from the first aerator, may be entrained by air bubbles from the second aerator, as the air bubbles from the second aerator rise upwardly through the liquid phase to the froth/liquid interface.

The delivery of the substantially constant supply of feed to the first aerator may include the prior steps of:

introducing a supply fesh feed into a feed sump;

discharing tailings from the flotation vessel into the feed sump; and removing a substantially constant volume of feed from the feed sump to supply the substantially constant volume of feed to the first aerator.

The supply of fresh feed may be introduced into a fresh feed zone of the feed sump, and the tailings may be discharged into a tailings zone of the feed sump, with part of the tailings discharged into the tailings zone entering the fresh feed zone, so that the substantially constant volume of feed removed from the feed sump comprises a mixture of fresh feed and tailings, whilst the remainder of the tailings is discharged from the tailings zone.

The method may include the step of monitoring the level of the froth/liquid interface to control the rate at which tailings are discharged from the flotation vessel.

The substantially constant volume of feed from the feed sump may be removed via a pump operating at a fixed speed.

The level of the surface of the fresh feed zone may be maintained below the level of the surface of the tailings zone in the feed sump.

According to a further aspect of the invention a flotation plant includes:

means for delivering a substantially constant supply of feed;

a first aerator for aerating the substantially constant supply of feed;

a flotation vessel into which the substantially constant supply of aerated feed is introduced; and a second aerator located within the flotation vessel, and located below the level at which the substantially constant supply of aerated feed is introduced into the flotation vessel.

The means for delivering a substantially constant supply of feed may include:

a feed sump;

a fresh feed conduit for discharging fresh feed into the feed sump;

a tailings conduit for discharging tailings from the flotation column into the feed sump; and a pump for delivering a substantially constant volume of feed to the first aerator.

The feed sump may include:

a fresh feed zone and a tailings zone in communication with one another via a restricted opening, so that the fresh feed can be discharged from the fresh feed conduit into the fresh feed zone, and tailings can be discharged from the tailings conduit into the tailings zone; and a tailings discharge zone from which excess tailings can be discharged from the tailings zone.

Level control means for controlling the level of an interface between froth and liquid phases within the flotation vessel may be provided.

The fresh feed zone and the tailings zone within the feed sump may be separated from one another by a partition, with the restricted opening being located below the partition.

DETAILED DESCRIPTION OF THE INVENTION

The invention will now be described by way of a non-limiting example, with reference to the accompanying drawing FIG. 1 which is a diagrammatic layout of a flotation plant according to the invention.

Referring to the FIG. 1, a flotation plant 10 includes a feed sump 14 and a flotation column 12.

The feed sump 14 has a fresh feed zone 16 and a tailings zone 18, separated from one another by a partition 20. The partition 20 terminates short of a sloping bottom 22 of the feed sump 14, thereby creating a restricted opening 24, between the fresh feed zone 16 and the tailings zone 18. A tailings overflow zone 26 is located adjacent the tailings zone 18. A tailings sump 28 is provided for tailings which overflow from the tailings overflow zone 26. Fresh feed is fed into the fresh feed zone 16 via a fresh feed conduit 30.

A fixed speed pump 32, feeds a substantially constant volume of a mixture of fresh feed and tailings to an external aerator 34, which has an air supply conduit 37. The aerator 34 aerates the feed which is then fed into the flotation column 12. An internal aerator 36, known as an air sparger, is located within the flotation apparatus 12.

The flotation apparatus 12 has a liquid phase 38, and a froth phase 40 separated from one another by an interface 42. Froth is discharged from the flotation column 12 into a launder 44. Tailings are discharge from the flotation column via a tailings conduit 46 into the tailings zone 18 of the feed sump 14.

A level sensor 48 is used to sense the level of the interface 42. The level sensor 48 provides a signal to a level controller 50 which has a set point input 52. The level controller controls the rate of discharge of tailings through the tailings conduit 46 via a valve 54.

The capacity of the pump 32 is specified at a value which ensures that the flowrate of the feed to the flotation column 12, is larger than the maximum flowrate of fresh feed via the fresh feed conduit 30 fed to the feed sump 14. This ensures that the level of the surface 56 of the fresh feed within the fresh feed zone 16, is always below the level of the surface 58 of the tailings within the tailings zone 18. This results in a net flowrate of tailings through the restricted opening 24 into the fresh feed zone 16.

The size and shape of the tailings zone 18 may be selected to ensure that large particles can settle preferentially to the bottom of the tailings zone 18, and enter the fresh feed zone 16 through the restricted opening 24. These large particles (which settle rapidly through the liquid phase 38 in the flotation column 12) are thus given a second chance to be collected by air bubbles within the flotation column 12. Alternatively, the size and shape of the tailing zone 18 may be selected to ensure turbulent conditions within the tailings zone 18, to prevent settlement of large particles so that a general cross-section of particles is recycled to the flotation column 12.

It will be appreciated that many modifications or variations of the invention are possible without departing from the spirit or scope of the invention.

I claim:

1. A method of separating particulate material including the steps of:

introducing a supply of fresh feed into a fresh feed zone of a feed sump;

discharging tailings from the flotation vessel into a tailings zone of the feed sump, the fresh feed zone being separated from the tailings zone by a partition having an opening, with part of the tailings discharged into the tailings zone entering the fresh feed zone through the opening;

removing a substantially constant volume of feed from the feed sump to supply the substantially constant volume of feed to a first aerator, the substantially constant volume of feed removed from the feed sump comprising a mixture of fresh feed and part of the tailings, the remainder of the tailings being discharged from the tailings zone;

aerating the substantially constant supply of feed in the first aerator;

introducing the substantially constant supply of aerated feed to a flotation vessel below a froth/liquid interface within the vessel, so that floatable particulate material entrained by air bubbles from the first aerator can float upwardly to the froth/liquid interface; and introducing air into the liquid phase in the flotation vessel via a second aerator located below the level at which the aerated feed is introduced into the flotation vessel, so that floatable particulate material not entrained by air bubbles from the first aerator may be entrained by air bubbles from the second aerator as the air bubbles from the second aerator rise upwardly through the liquid phase to the froth/liquid interface.

2. The method of claim 1 including the step of monitoring the level of the froth/liquid interface to control the rate at which tailings are discharged from the flotation vessel.

3. The method of claim 1 including the step of removing the substantially constant volume of feed from the feed sump via a pump operating at a fixed speed.

4. The method of claim 1 including the step of maintaining the level of the surface of the fresh feed zone below the level of the surface of the tailings zone in the feed sump.

* * * * *